US006377132B1

(12) United States Patent
Wakamatsu et al.

(10) Patent No.: US 6,377,132 B1
(45) Date of Patent: Apr. 23, 2002

(54) FILTER, DUPLEXER, AND COMMUNICATION DEVICE

(75) Inventors: Hiroki Wakamatsu, Kyoto; Taiyo Nishiyama, Otsu; Yukihiro Nakatani, Kyoto; Yoshihiro Himi, Muko, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/186,512

(22) Filed: Nov. 4, 1998

(51) Int. Cl.[7] ..... H01P 1/201

(52) U.S. Cl. ..... 333/134; 333/230; 333/202; 333/219.1

(58) Field of Search ..... 333/230, 222, 333/202, 219, 219.1, 206, 134, 212, 202 DR

(56) References Cited

U.S. PATENT DOCUMENTS

| | | | | |
|---|---|---|---|---|
| 5,004,992 A | * | 4/1991 | Grieco et al. | 333/202 |
| 5,625,330 A | | 4/1997 | Wilson et al. | 333/230 |
| 6,025,764 A | * | 2/2000 | Pelz et al. | 333/202 |
| 6,081,173 A | * | 6/2000 | Sonoda et al. | 333/202 |

FOREIGN PATENT DOCUMENTS

| | | | | |
|---|---|---|---|---|
| FR | 2118859 | | 8/1972 | |
| JP | 406085504 A | * | 3/1994 | 333/202 DR |

OTHER PUBLICATIONS

Patent Abstracts of Japan, vol. 96, No. 7, Jul. 31, 1996 & JP 08 084008 A (Murata Mfg Co Ltd), Mar. 26, 1996, abstract.

Patents Abstracts of Japan, vol. 13, No. 136 (E–737), Apr. 5, 1989 & JP 63 299602 A (Murata Mfg Co Ltd), Dec. 7, 1988, abstract.

* cited by examiner

*Primary Examiner*—Robert Pascal
*Assistant Examiner*—Stephen E. Jones
(74) *Attorney, Agent, or Firm*—Ostrolenk, Faber, Gerb & Soffen, LLP

(57) ABSTRACT

A filter includes a dielectric resonator, a cavity for holding the dielectric resonator therein, an external connector mounted on the cavity, and a coupling loop connected to the external connector so as to electromagnetically couple with the dielectric resonator. The coupling loop is formed by bending a metal plate nearly into the shape of an L, and is provided with a rib extending in a direction that is not parallel to the bending line.

7 Claims, 6 Drawing Sheets

FILTER, DUPLEXER, AND COMMUNICATION DEVICE

BACKGROUND OF THE INVENTION

1. Field of the Invention

The present invention relates to a filter having a coupling loop, to a duplexer, and to a communication device.

2. Description of the Related Art

As FIG. 10 shows, a conventional filter 110 comprises a dielectric resonant device 120, metal panels 111 having an external connector 113 that serves as an input-output connecting means and covers open portions of the dielectric resonant device 120, and a coupling loop 112.

The dielectric resonant device 120 includes a frame 121 and a dielectric resonator 122 that are made of ceramic. The frame 121 is shaped like a parallelepiped with two opposing surfaces being open, and is provided with conductors 123 thereon. The dielectric resonator 122 is shaped like a rectangular parallelepiped, and is disposed inside the frame 121 so that its two opposing surfaces are integrated with the frame 121. The metal panels 111 are made of metal, such as iron or a nickel alloy, in order to achieve good electrical conductivity and to make the coefficient of linear expansion thereof the same as that of a dielectric. These metal panels 111 are connected to the conductors 123 of the dielectric resonant device 120, whereby a cavity 130 is formed as a whole.

The coupling loop 112 is made of copper in view of electrical conductivity and rust prevention, and worked into the shape of an L. One end of the coupling loop 112 fits in a hole that is previously formed through the metal panel 111, and is fixed by soldering or the like. The other end of the coupling loop 112 is connected to the external connector 113. Since this other end of the coupling loop 112 is also worked into a corrugated shape, it can, for example, absorb impact that is applied from the side of the external connector 113. This has solved problems, for example, deformation of the coupling loop 112 due to stress from the outside, and separation of the coupling loop 112 from the metal panel 111.

In the filter 110 mentioned above, current applied from the outside flows in the coupling loop 112 via the external connector 113. The current that flows through the coupling loop 112 generates a magnetic field, and this magnetic field couples with the dielectric resonator 122. In this case, the degree of coupling between the coupling loop 112 and the dielectric resonator 122 is adjusted based on the length, thickness, and width of the coupling loop 112 or the distance between the coupling loop 112 and the dielectric resonator 122. Such adjustment of the degree of coupling allows a filter having the required electrical characteristics.

A coupling loop has its own natural frequency, and the natural frequency of a coupling loop in a conventional filter is about 260 Hz. On the other hand, in normal use of the filter, a device itself, in which the filter is incorporated, vibrates with the vibrations applied from the outside. In this case, frequencies ranging from about 5 Hz to 200 Hz are a problem. There is a likelihood that a coupling loop will resonate with the vibrations from the outside. The coupling loop resonates because the frequency of the external vibrations is almost equivalent to the natural frequency of the coupling loop. Although the natural frequency of the conventional coupling loop does not coincide with the frequency of the external vibrations, if it remains about 260 Hz, the attenuation amount is not sufficient near about 200 Hz, which is an unnecessary signal, thereby affecting the filter characteristics to a degree that is not disregarded. As the coupling loop resonates with the external vibrations, the degree of coupling between the coupling loop and the dielectric resonator varies, and the electrical characteristics, such as return loss, are thereby disturbed. Moreover, reliability of the filter is deteriorated.

In order to solve the above problems, it may be possible to further increase the natural frequency of the coupling loop so that the resonance with the external vibrations can be disregarded. Incidentally, the coupling loop can be regarded as having a beam structure. In general, the natural frequency of a beam is expressed by the following formula:

Natural Frequency $$f = \frac{C}{l^2}\sqrt{\frac{EI}{pA}}$$

where C is a constant, l is the length of the beam, E is the Young's modulus of the beam, I is the second moment of area of the beam, p is the density of the beam, and A is the sectional area of the beam.

Referring to the above formula, it may be possible to reduce the length of the beam in order to increase the natural frequency of the coupling loop. Since the length of the beam has an influence on the degree of coupling with the dielectric resonator, however, it cannot be easily changed. Accordingly, it is good, in practice, to change the bending rigidity of the beam. The bending rigidity of the beam is given by the product of the Young's modulus and the second moment of area of the material. Therefore, the bending rigidity of the beam can be improved by increasing the Young's modulus or the second moment of area of the material. Although iron is available as a material having a high Young's modulus, the use of iron for the coupling loop causes a new problem, that is, thorough rust prevention is required. When the coupling loop is made of iron, in general, intermodulation (IM) is apt to occur, and therefore, the coupling loop is plated with silver. If the silver plate rusts, however, iron appears on the surface thereof, and IM is likely to occur. Although it may also be possible to increase the thickness of the coupling loop in order to increase the second moment of area, this results in an increase in the material cost.

The coupling loop is formed by bending a metal plate into the shape of an L. Therefore, the strength of the bent portion is low, and this leads to a fear that the positional relationship between the coupling loop and the dielectric resonator may change.

Furthermore, one end of the coupling loop on the side of the external connector has been heretofore corrugated so as to absorb impact from the external connector. It is, however, not so easy to corrugate an end of the coupling loop, and costs become high.

SUMMARY OF THE INVENTION

The present invention has been made with a view toward solving the above problems. It is accordingly an object of the present invention to provide a filter, a duplexer, and a communication device that are hardly affected by vibrations applied from the outside and that have high reliability.

According to an aspect of the present invention, there is provided a filter having a cavity, an input-output connecting means mounted in the cavity, and a coupling loop connected to the input-output connecting means so as to couple with a magnetic field inside the cavity, wherein the coupling loop has a natural-frequency increasing means for increasing the natural frequency thereof.

According to another aspect of the present invention, there is provided a filter having a cavity, an input-output connecting means mounted in the cavity, and a coupling loop connected to the input-output connecting means so as to couple with a magnetic field inside the cavity, wherein the coupling loop is formed by bending a metal plate, and is provided with a rib extending in a direction that is not in parallel with a bending line.

According to a further aspect of the present invention, there is provided a filter having a cavity, an input-output connecting means mounted in the cavity, and a coupling loop connected to the input-output connecting means so as to couple with a magnetic field inside the cavity, wherein the coupling loop including a section having high rigidity and a curved section having low rigidity, one end of the high-rigidity section is connected to the cavity, the other end thereof is connected to one end of the low-rigidity curved section, and the other end of the low-rigidity curved section is connected to the input-output connecting means.

Preferably, a dielectric resonator is disposed inside the cavity.

Preferably, a rib is formed in a bent portion of the coupling loop.

This structure makes it possible to increase the natural frequency of the coupling loop, and to thereby prevent the coupling loop from resonating with vibrations from the outside. Moreover, it is possible to mechanically reinforce the bent portion of the coupling loop, and to limit the change of degree of coupling, whereby a reliable filter can be provided.

Accordingly, it is possible to easily manufacture at low cost a coupling loop that is connected to an external connector and that absorbs impact applied through the external connector. In addition, it is possible to provide a reliable filter in which change of degree of coupling is prevented.

According to a further aspect of the present invention, there is provided a duplexer including at least two filters, input-output connecting means connected to the filters, and an antenna connecting means commonly connected to the filters, wherein at least one of the filters is a filter of the above-mentioned type.

According to a still further aspect of the present invention, there is provided a communication device including the above-mentioned duplexer, a transmission circuit connected to at least one of the input-output connecting means in the duplexer, a receiving circuit connected to at least one of the input-output connecting means that differs from the input-output connecting means connected to the transmission circuit, and an antenna connected to the antenna connecting means in the duplexer.

According to the above, it is possible to obtain a duplexer and a communication device having stable properties and high reliability.

Further objects, features and advantages of the present invention will become apparent from the following description of the preferred embodiments with reference to the attached drawings.

DESCRIPTION OF THE PREFERRED EMBODIMENTS

A filter according to an embodiment of the present invention will be described below with reference to the attached drawings. A dielectric resonant device in this embodiment is of a type in which a dielectric resonator is disposed inside a frame.

Figure 1:
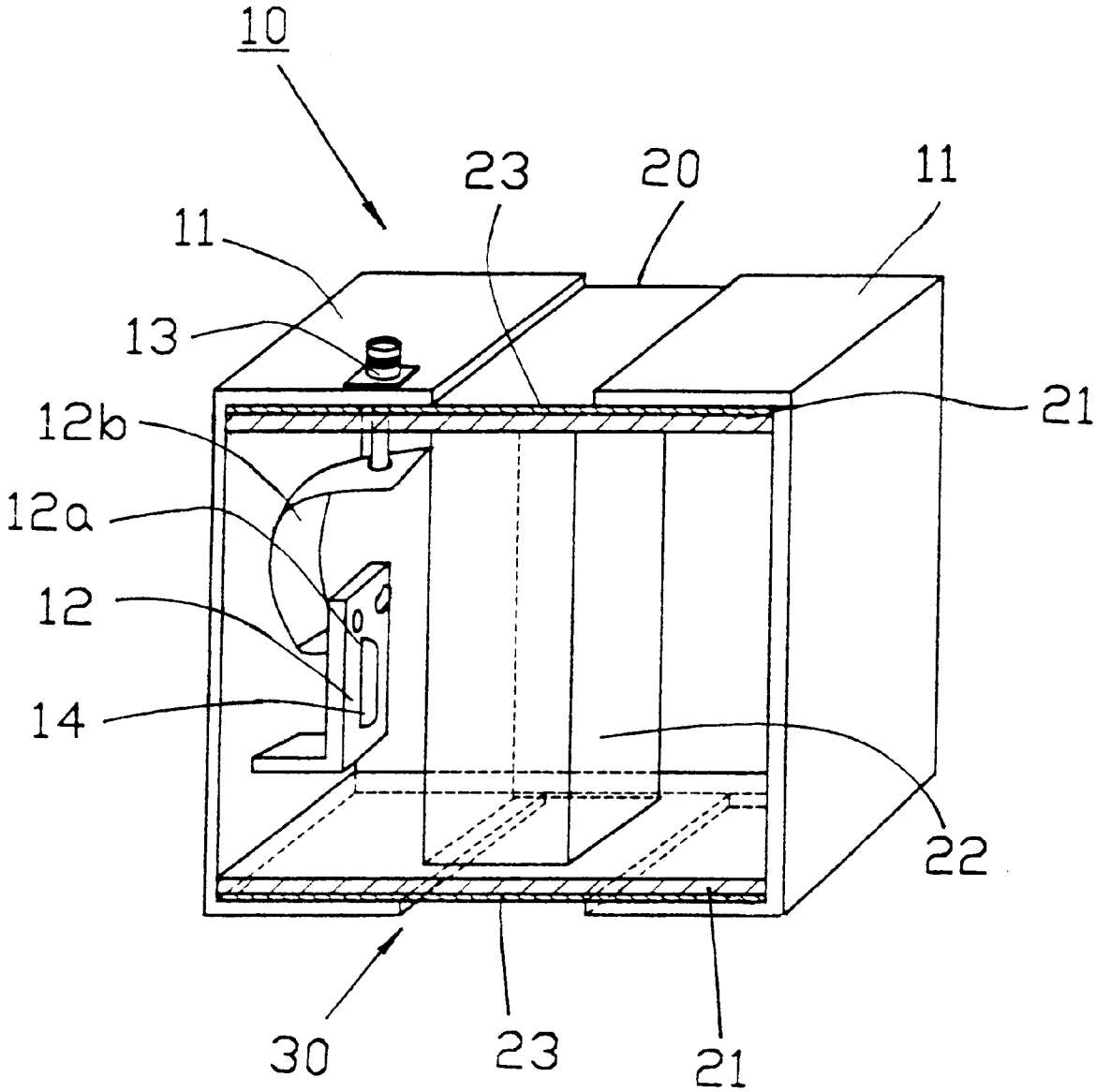
FIG. 1 is a perspective view of a filter according to the present invention.

FIG. 1 is a schematic perspective view of the filter according to the present invention. In FIG. 1, the filter is cut along the plane perpendicular to the open surface of a dielectric resonant device 20, in order for the inside thereof to be seen well. Although coupling loops 12, and external connectors 13 that serve as input-output connecting means are provided for input and output, since they have the same structure, only one of the coupling loops 12 and one of the external connectors 13 are illustrated and described.

The filter 10 generally comprises a TM mode dielectric resonant device 20, and metal panels 11 mounted to cover open portions of the dielectric resonant device 20.

In the TM mode dielectric resonant device 20, a dielectric resonator 22 made of ceramic and shaped like a column is disposed inside a frame 21 that is also made of ceramic, and conductors 23 are formed by applying and baking silver paste on the frame 21.

The metal panels 11, which are mounted at the open portions of the dielectric resonant device 20, are worked from a metal plate of iron, a nickel alloy, or the like, by pressing or stamping, and are provided with the coupling loop 12 and the external connector 13. The metal panels 11 are soldered so as to cover the open portions of the dielectric resonant device 20, and connected to the conductors 23 of the dielectric resonant device 20, whereby a cavity 30 is formed as a whole.

A metal cover is further mounted on the filter 10, though it is not shown in FIG. 1, to maintain stability in installation, to prevent impact from being transmitted from the outside to the inside, and to mechanically reinforce an external connector section.

The coupling loop 12 includes a section having high rigidity 12*a* and a section having low rigidity 12*b*. The high-rigidity section 12*a* is formed by bending a metal plate of copper or the like into the shape of an L. In contrast, the low-rigidity section 12*b* is formed by curving a metal plate that is made of phosphor bronze or the like and that has a smaller thickness than that of the high-rigidity section 12*a*, so that it has flexibility.

A rib 14 is formed in a part of the high-rigidity section 12*a* that is parallel to the metal panel 11 so as to increase the second moment of area.

Figure 2:
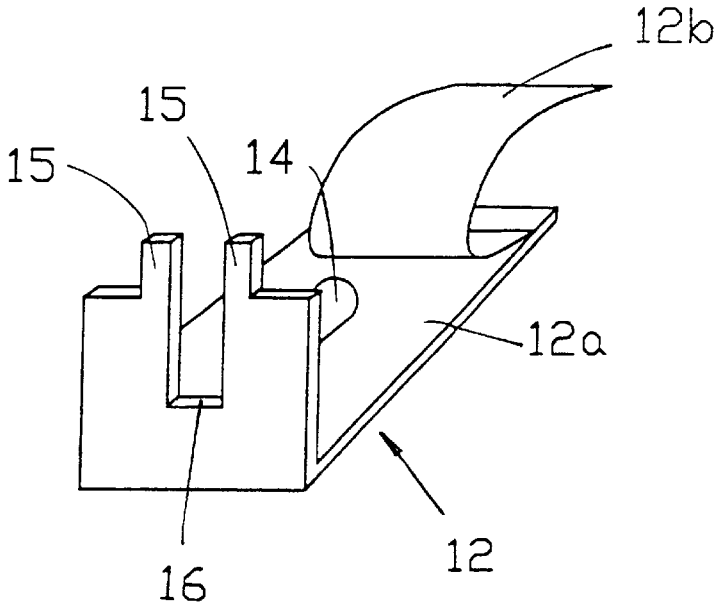
FIG. 2 is a perspective view of a coupling loop shown in FIG. 1.

The high-rigidity section 12*a* also has a cutout portion 16 at one end thereof, as shown in FIG. 2, so that elastic force acts on the force exerted from the widthwise direction of the cutout portion 16. Moreover, two projecting portions 15 are formed to sandwich the cutout portion 16. The metal panel 11 has a hole whose bore is smaller than the width of the two projecting portions 15. By being inserted in this hole formed through the metal panel 11, the projecting portions 15 of the high-rigidity section 12*a* are retained from both sides. Then, the projecting portions 15 are temporarily attached by using the elastic force to expand, and are fixed by soldering. The high-rigidity section 12*a* has a hole at the other end. One end portion of the low-rigidity section 12*b* is inserted in the hole, bent, and fixed by soldering. The other end of the low-rigidity section 12*b* also has a hole, in which the leading end of a center conductor of the external connector 13 is fixedly inserted.

Figure 3:
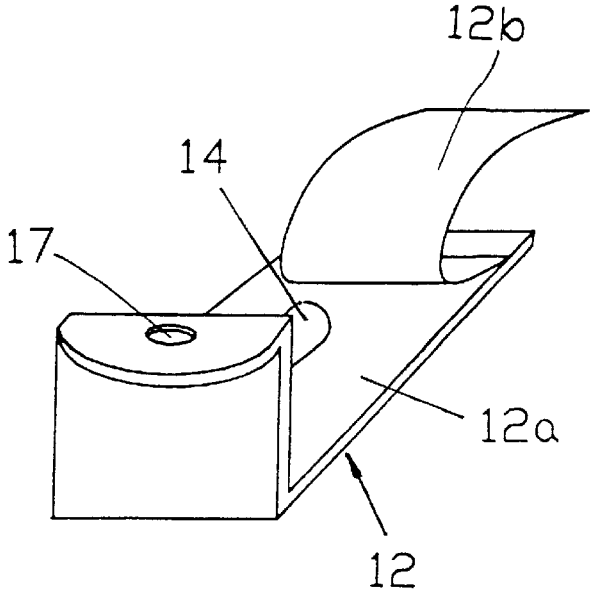
FIG. 3 is a perspective view showing another example of a coupling loop according to the present invention.

One end of the high-rigidity section 12*a* that is connected to the metal panel 11 may be further bent into the shape of an L so that a surface having a hole 17 is formed to be bonded to the metal panel 11, as shown in FIG. 3. In this case, a projection is formed on the metal panel 11 by stamping or louvering the metal panel 11 inward. The projection of the metal panel 11 is inserted in the hole 17, bent, and fixed by soldering. This simplifies the operation and improves stability of the bonded portion.

FIGS. 4 to 7 demonstrate variations of the rib 14, and each shows only the high-rigidity section 12*a* of the coupling loop 12 that is worked into the shape of an L and fixed to the metal panel 11.

Figure 4:
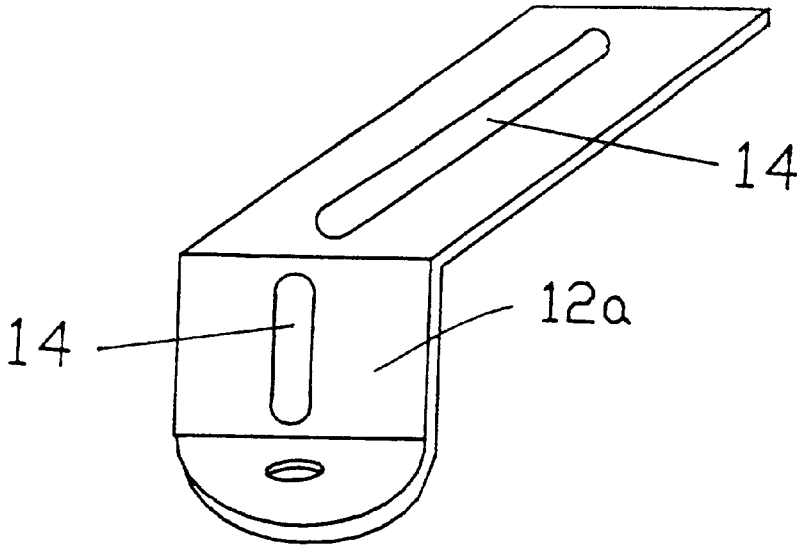
FIG. 4 is a perspective view showing only a high-rigidity section of a further example of a coupling loop according to the present invention.

In the variation shown in FIG. 4, a rib 14 is also formed in a part of the high-rigidity section 12*a* in the coupling loop 12, which is nearly perpendicular to the metal panel 11, so that it extends in the direction nearly perpendicular to the metal panel 11, thereby further increasing the natural frequency.

Figure 5:
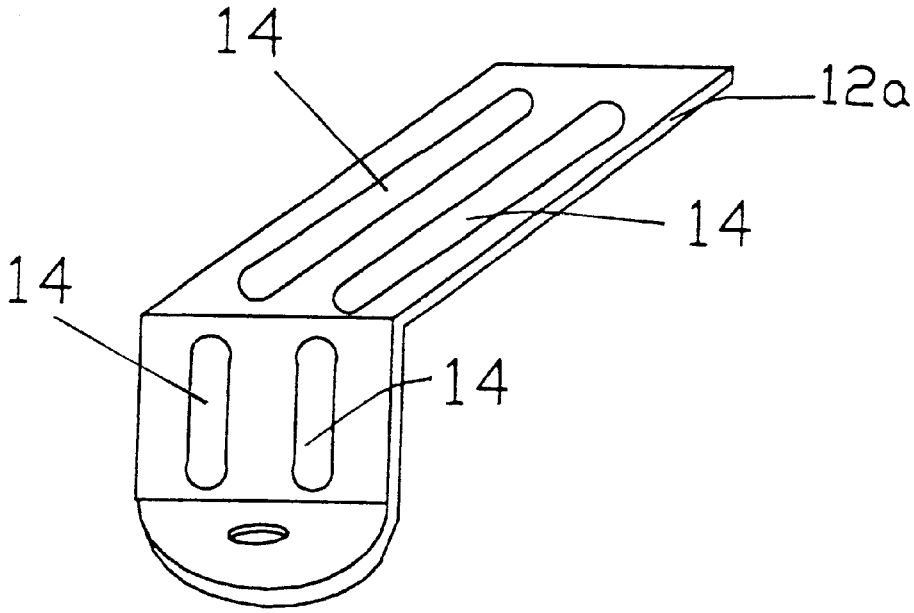
FIG. 5 is a perspective view showing only a high-rigidity section of a further example of a coupling loop according to the present invention.

There may be provided a plurality of ribs 14, as shown in FIG. 5. In this case, the natural frequency of the coupling loop 12 can be further increased.

Figure 6:
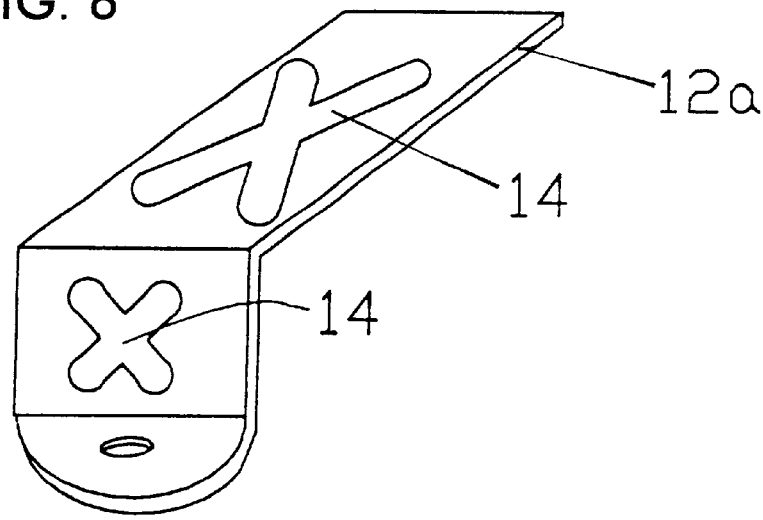
FIG. 6 is a perspective view showing only a high-rigidity section of a further example of a coupling loop according to the present invention.

When the rib 14 is shaped like a cross, as shown in FIG. 6, it is possible to increase the strength of the coupling loop 12 with respect to vibrations in other directions.

Figure 7:
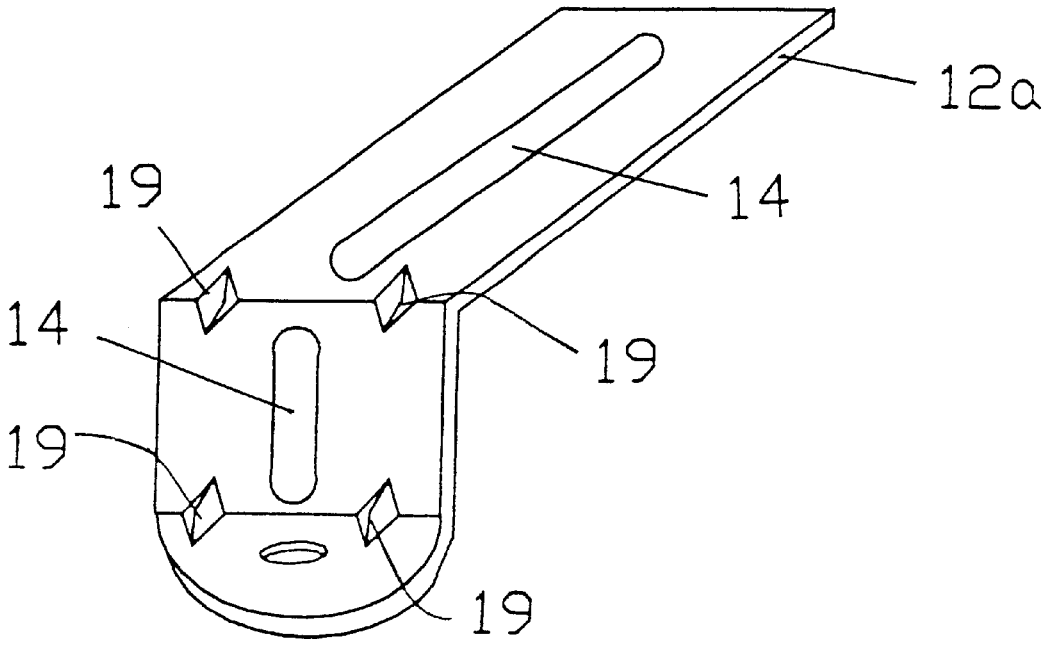
FIG. 7 is a perspective view showing only a high-rigidity section of a further example of a coupling loop according to the present invention.

As shown in FIG. 7, ribs 19 may be formed in bent portions of the high-rigidity section 12*a* of the coupling loop 12. This makes it possible to increase the mechanical strength of the bent portions, to prevent a change in the bending angle of the coupling loop 12, and to prevent a change in the degree of coupling between the coupling loop 12 and the dielectric resonator 22. As a result, a filter having high reliability can be provided.

While the filter of this embodiment employs a dielectric resonant device in which a dielectric resonator shaped like a column is disposed inside a ceramic frame, the present invention is not limited to the illustrated embodiment. The present invention may also be applied to, for example, a filter using a double-mode or multiple-mode dielectric resonant device in which a cross-shaped dielectric resonator is placed.

The present invention may also be applied to any device using a coupling loop, for example, a waveguide filter in which a coupling loop is mounted in a metal cavity.

Figure 8:
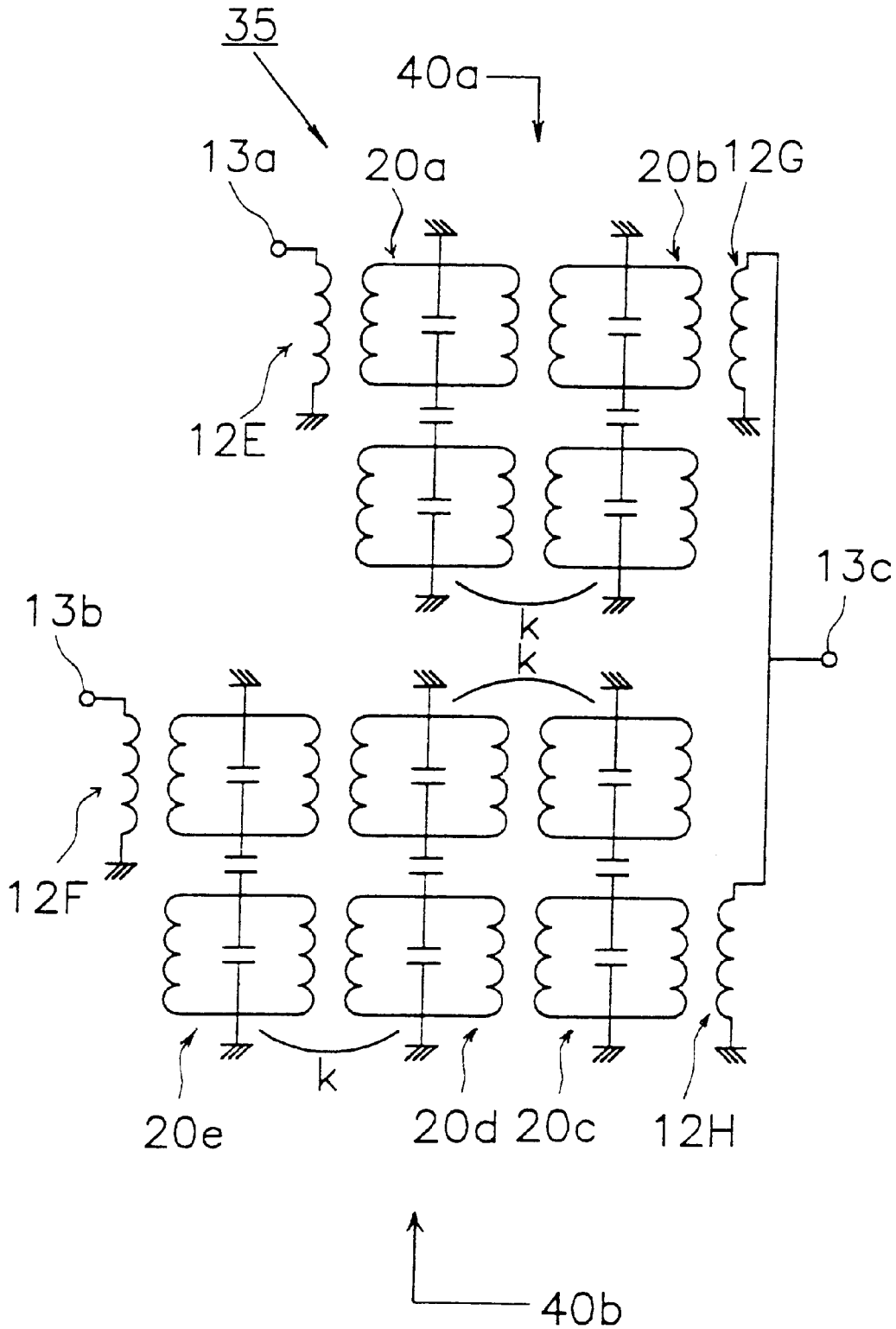
FIG. 8 is an equivalent circuit diagram of a duplexer according to the present invention.

Next, a duplexer according to an embodiment of the present invention will be described with reference to FIG. 8. FIG. 8 is an equivalent circuit diagram of the duplexer of this embodiment.

As shown in FIG. 8, a duplexer 35 of this embodiment comprises a four-stage transmission filter 40*a* composed of two double-mode dielectric resonant devices 20*a* and 20*b*, and a six-stage receiving filter 40*b* composed of three double-mode dielectric resonant devices 20*c*, 20*d*, and 20*e*. In each of the dielectric resonant devices 20*a* to 20*e* used in the transmission filter 40*a* and the receiving filter 40*b*, a cross-shaped dielectric resonator is placed in a frame having a conductor formed on the outer surface thereof, and two modes are coupled by forming a cutout for coupling at an intersection of the dielectric resonator, or other methods.

A metal panel is mounted at an open portion of each of the dielectric resonant devices 20*a* to 20*e* so that it covers the open portion, and is provided with a coupling loop having the shape that has been described in the above embodiments. Coupling loops 12E and 12F, which are coupled to the first stage of the transmission filter 40*a* and the last stage of the receiving filter 40*b*, respectively, are connected to external connectors 13*a* and 13*b* mounted on the metal panel. Furthermore, coupling loops 12G and 12H coupled to the last stage of the transmission filter 40*a* and the first stage of the receiving filter 40*b* are commonly connected to a single external connector 13*c*. On the other hand, coupling loops are mounted between the second and third stages of the transmission filter 40*a*, between the second and third stages of the receiving filter 40*b*, and between the fourth and fifth stages of the receiving filter 40*b* in order to couple the dielectric resonant devices. A line, such as a coaxial line, connected to the external connector 13*a*, to which the coupling loop 12E coupled with the first stage of the transmission filter 40*a* is connected, is connected to an external transmission circuit, and a line connected to the external connector 13*b*, to which the coupling loop 12F coupled to the last stage of the receiving filter 40*b* is connected, is connected to an external receiving circuit. Furthermore, a line connected to the external connector 13*c*, to which the coupling loops 12G and 12H coupled to the last stage of the transmission filter 40*a* and the first stage of the receiving filter 40*b* are commonly connected, is connected to an antenna.

In the duplexer 35 having such a configuration, a signal having a predetermined frequency, of signals input from the external transmission circuit to the transmission filter 40*a*, is output to the antenna, and a signal having a predetermined frequency, which is different from the aforesaid frequency, of signals input from the antenna to the receiving filter 40*b*, is output to the external receiving circuit.

Figure 9:
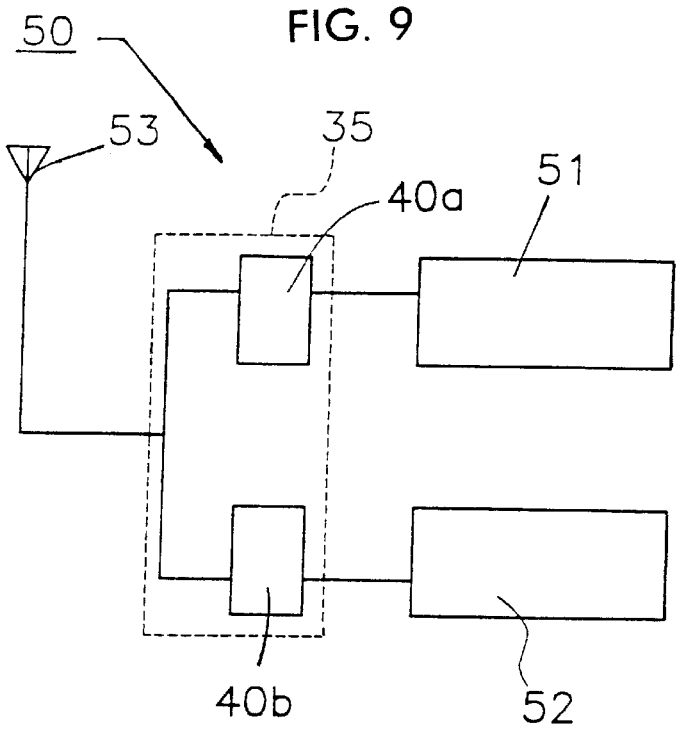
FIG. 9 is a schematic view of a communication device according to the present invention.
Figure 10:
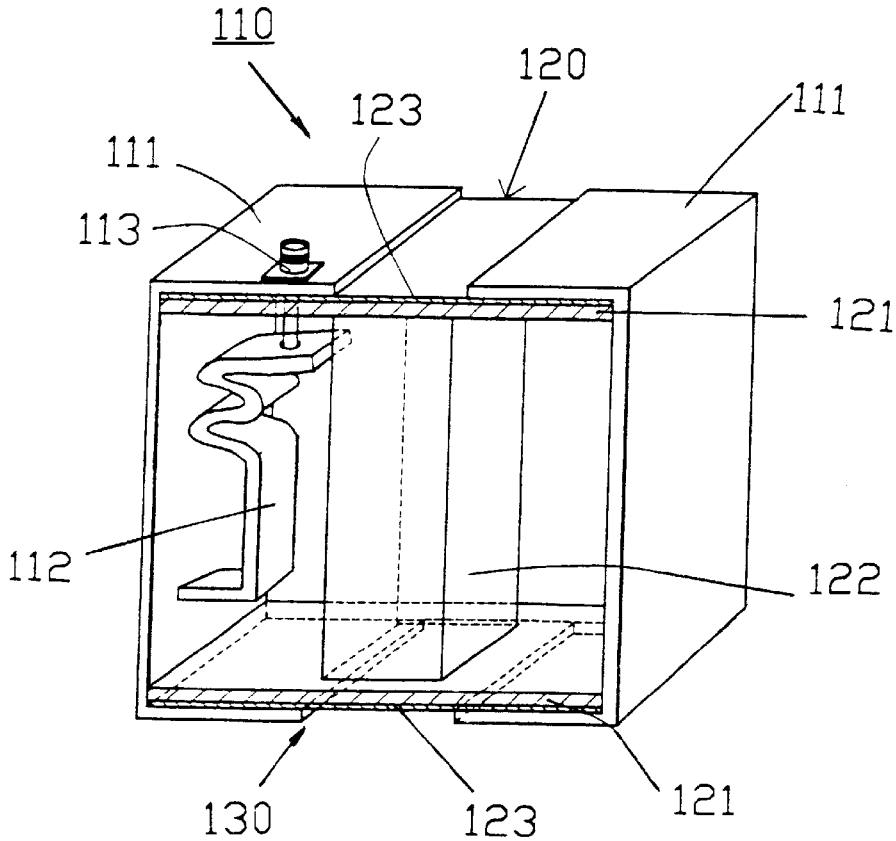
FIG. 10 PRIOR ART
FIG. 10 is a perspective view of a conventional filter.

Furthermore, a communication device according to an embodiment of the present invention will be described with reference to FIG. 9. FIG. 9 is a schematic view of the communication device of this embodiment.

As shown in FIG. 9, a communication device 50 of this embodiment comprises a duplexer 35, a transmission circuit 51, a receiving circuit 52, and an antenna 53. The duplexer 35 is the same as that described in the above embodiment. The coupling loop 12E coupled to the first stage of the transmission filter 40*a* is connected to the transmission circuit 51 via the external connector 13*a* and the line, and the coupling loop 12F coupled to the last stage of the receiving filter 40*b* is connected to the receiving circuit 52 via the external connector 13*b* and the line. Moreover, the coupling loop 12C coupled to the last stage of the transmission filter

40*a* and the coupling loop 12H coupled to the first stage of the receiving filter 40*b* are connected to the antenna 53 via the external connector 13*c* and the line.

In the duplexer and the communication device mentioned in the above embodiments, since the natural frequency of the coupling loop is apart from the frequency that has been a problem, the properties are stabilized, thereby improving reliability.

As mentioned above, according to the present invention, the natural frequency of the coupling loop is increased by forming a rib in the coupling loop, for example, increased to about 380 Hz in the case in which a single rib is formed, as shown in FIG. 1. This allows a satisfactory attenuation amount near 200 Hz. The resonation resulting from the external vibration, which has been a problem hitherto, can be reduced to a negligible degree, thereby preventing the electrical characteristics, such as return loss, from being disturbed. As a result, it is possible to provide a filter having high reliability.

Furthermore, the bent portion of the coupling loop can be mechanically reinforced by a rib formed therein. As a result, it is possible to further improve stability of the coupling loop, and to prevent a change in the degree of coupling between the coupling loop and the electromagnetic field generated in the cavity.

Still furthermore, the coupling loop including two sections, an L-shaped section having high rigidity, and a curved section having low rigidity. One end of the high-rigidity L-shaped section is connected to the cavity, the other end thereof is connected to one end of the low-rigidity curved section, and the other end of the low-rigidity curved section is connected to the external connector. This permits the low-rigidity section of the coupling loop to absorb impact from the external connector. Consequently, it is possible to provide a filter having stable characteristics.

What is claimed is:

1. A filter having a cavity, an input-output connector mounted in said cavity, and a coupling loop connected to said input-output connector so as to couple with a magnetic field inside said cavity, wherein said coupling loop includes a section having high rigidity and a curved section having low rigidity, one end of said high-rigidity section is connected to a wall in said cavity, the other end thereof is connected to one end of said low-rigidity curved section, and the other end of said low-rigidity curved section is connected to said input-output connector;

wherein said section having high rigidity is formed by bending a metal plate, and is provided with a rib extending in a direction that is not in parallel with a bending line.

2. A filter according to claim 1, wherein said rib is formed in a bent portion of said section having high rigidity.

3. A filter according to claim 1, wherein a dielectric resonator is disposed inside said cavity.

4. A filter having a cavity, an input-output connector mounted in said cavity, and a coupling loop connected to said input-output connector so as to couple with a magnetic field inside said cavity, wherein said coupling loop includes a section having high rigidity and a curved section having low rigidity, one end of said high-rigidity section is connected to a wall in said cavity, the other end thereof is connected to one end of said low-rigidity curved section, and the other end of said low-rigidity curved section is connected to said input-output connector;

wherein a dielectric resonator is disposed inside said cavity; and wherein a rib is formed in a bent portion of said section having high rigidity.

5. A filter according to claim 4, wherein said section having high rigidity is formed by bending a metal plate, and said rib extends in a direction that is not in parallel with a bending line.

6. A duplexer comprising:

at least two filters;

two input-output connectors connected respectively to said filters; and an antenna connector commonly connected to said filters, wherein at least one of said filters is a filter according to any of claims 1, 2, 3 and 4.

7. A communication device comprising:

a duplexer according to claim 6;

a transmission circuit connected to one of said two input-output connectors in said duplexer;

a receiver circuit connected to one of said two input-output connectors that differs from said input-output connector connected to said transmission circuit.

* * * * *